US010686273B2

(12) United States Patent
Ogura

(10) Patent No.: US 10,686,273 B2
(45) Date of Patent: Jun. 16, 2020

(54) CONNECTOR HAVING TERMINAL WITH CONTACT PORTION FIXED TO A HOUSING

(71) Applicant: IRISO ELECTRONICS CO., LTD., Yokohama-shi, Kanagawa (JP)

(72) Inventor: Yoshiyuki Ogura, Yokohama (JP)

(73) Assignee: IRISO ELECTRONICS CO., LTD., Yokohama-shi, Kanagawa (JP)

( * ) Notice: Subject to any disclaimer, the term of this patent is extended or adjusted under 35 U.S.C. 154(b) by 0 days.

(21) Appl. No.: 16/353,024

(22) Filed: Mar. 14, 2019

(65) Prior Publication Data

US 2019/0288429 A1 Sep. 19, 2019

(30) Foreign Application Priority Data

Mar. 15, 2018 (JP) ..... 2018-048293

(51) Int. Cl.
*H01R 13/11* (2006.01)
*H01R 13/24* (2006.01)
(Continued)

(52) U.S. Cl.
CPC ..... *H01R 13/24* (2013.01); *H01R 12/57* (2013.01); *H01R 12/716* (2013.01); *H01R 12/91* (2013.01);
(Continued)

(58) Field of Classification Search
CPC ..... H01R 13/112
See application file for complete search history.

(56) References Cited

U.S. PATENT DOCUMENTS 3,142,891 A * 8/1964 Travis ..... H01R 43/16 72/376
3,823,392 A * 7/1974 Pfeifer ..... H01R 13/112 439/856
(Continued)

FOREIGN PATENT DOCUMENTS

CN 201699182 U 1/2011
EP 2 806 502 A1 11/2014
JP 2014165066 A 9/2014

OTHER PUBLICATIONS

Extended European Search Report dated Aug. 8, 2019 in corresponding European Patent Application No. 19162126.7.

*Primary Examiner* — Tho D Ta
(74) *Attorney, Agent, or Firm* — Buchanan, Ingersoll & Rooney PC

(57) ABSTRACT

To provide a connector that is less deformable even under a high contact pressure. A connector includes a housing having a fitting chamber, and a terminal that comes into conductive contact with a pin terminal in the fitting chamber. The terminal includes a fixing base fixed to the housing, a contact member extending from the fixing base and pressed against the pin terminal, and right and left press-supporting members extending from the fixing base. The press-supporting members include respective contact-receiving parts that face the contact member in the fitting chamber and are positioned side by side in a direction intersecting a direction of insertion of the pin terminal into the fitting chamber. Since the pressed pin terminal is received by the plurality of contact-receiving parts, the pressing force can be dispersed therebetween. Hence, the deformation of the contact member and the contact-receiving parts can be prevented.

4 Claims, 11 Drawing Sheets

(51) Int. Cl.

| | |
|---|---|
| ***H01R 12/57*** | (2011.01) |
| ***H01R 12/71*** | (2011.01) |
| ***H01R 13/502*** | (2006.01) |
| ***H01R 13/631*** | (2006.01) |
| ***H01R 12/91*** | (2011.01) |

(52) U.S. Cl.
CPC ..... *H01R 13/11* (2013.01); *H01R 13/502* (2013.01); *H01R 13/631* (2013.01); *H01R 13/112* (2013.01)

(56) References Cited

U.S. PATENT DOCUMENTS 4,458,971 A * 7/1984 D'Urso ..... H01R 13/432 439/268
4,685,886 A * 8/1987 Denlinger ..... H01R 13/11 439/374
4,894,027 A * 1/1990 Brantingham ..... H01R 33/09 439/699.2
5,997,347 A * 12/1999 Robinson ..... H01R 13/426 439/517
7,674,141 B2 * 3/2010 Canteri ..... H01R 13/112 439/856

* cited by examiner

CONNECTOR HAVING TERMINAL WITH CONTACT PORTION FIXED TO A HOUSING

BACKGROUND OF THE INVENTION

1. Field of the Invention

The present invention relates to a connector in which a terminal has a contact portion that comes into contact with a connection object, and the contact portion is fixed to a housing.

2. Description of the Related Art

One of known connectors intended for electronic apparatuses has a structure in which a terminal has a contact portion that comes into contact with a connection object, and the contact portion is fixed to a housing (see FIGS. 10 and 18 of Japanese Unexamined Patent Application Publication No. 2014-165066, for example). In the known connector, the terminal includes a first contact member and a second contact member that face each other in a direction intersecting a direction of insertion of the connection object so that the connection object is to be held therebetween. The first contact member and the second contact member are joined to each other with a U-shaped joining portion. The second contact member serves as a cantilever spring member. When the connection object is inserted into the connector, the second contact member presses the connection object against the first contact member.

SUMMARY OF THE INVENTION

If the contact pressure to be applied from the first contact member and the second contact member to the connection object is set to a high level so as to stabilize the contact between the terminal and the connection object, the joining member joining the first contact member and the second contact member may deform away from each other, leading to unstable contact. In addition, if the contact pressure generated as a pressing force by the first contact member and the second contact member is applied to the housing for a long time, the housing may deform under the pressing force. The deformation of the housing becomes significant particularly if the housing is heated in an environment at a high temperature or with the supply of a high current.

The present invention has been conceived in view of the above circumstances in the related art. An object of the present invention is to provide a connector including a terminal and a housing that are less deformable even if the contact pressure to be applied from a contact member of the terminal to a connection object is set to a high level.

To achieve the above object, the present invention has the following features.

The present invention provides a connector including a housing having a fitting chamber into which a connection object is to be inserted, and a terminal that comes into conductive contact with the connection object fitted in the fitting chamber. The terminal includes a fixing base that is fixed to the housing, a contact member that extends from the fixing base and is pressed against the connection object fitted in the fitting chamber, and a first press-supporting member and a second press-supporting member that each extend from the fixing base. The first press-supporting member and the second press-supporting member include a first contact-receiving part and a second contact-receiving part, respectively. The first contact-receiving part and the second contact-receiving part face the contact member in the fitting chamber and are positioned side by side in a direction intersecting a direction of insertion of the connection object into the fitting chamber.

According to the present invention, the connection object against which the contact member is pressed can be supported by the first contact-receiving part and the second contact-receiving part. Since the connection object thus pressed is received by the plurality of contact-receiving parts, the pressing force can be dispersed therebetween. Hence, the deformation of the contact member, the first contact-receiving part, and the second contact-receiving part can be prevented.

The first press-supporting member and the second press-supporting member may each be in a form of a cantilever extending from the fixing base without being fixed to the housing at all.

According to the present invention, since the first press-supporting member and the second press-supporting member are not fixed to the housing, none of or only a little, if any, of the pressing force received by the first press-supporting member and the second press-supporting member is transmitted to the housing. Therefore, even if the contact pressure to be applied from the contact member to the connection object is set to a high level, the housing is less likely to receive the pressing force and is less likely to deform. Hence, in the connector according to the present invention, the housing can be made less deformable even if the contact pressure to be applied from the contact member to the connection object is set to a higher level.

The first press-supporting member may include a first joining member that extends from the fixing base in such a manner as to run along a first side face of the connection object fitted in the fitting chamber, and is connected to the first contact-receiving part, and the second press-supporting member may include a second joining member that extends from the fixing base in such a manner as to run along a second side face of the connection object fitted in the fitting chamber, and is connected to the second contact-receiving part.

According to the present invention, the first joining member of the first press-supporting member runs along the first side face of the connection object, while the second joining member of the second press-supporting member runs along the second side face, different from the first side face, of the connection object. Therefore, the first contact-receiving part and the second contact-receiving part can bear a great pressing force applied thereto, with the force being evenly and effectively dispersed therebetween. Hence, in the connector according to the present invention, while the terminal and the connection object are stably kept in conductive contact with each other under an increased contact pressure, the deformation of the terminal and the housing can be prevented. Furthermore, the first press-supporting member and the second press-supporting member extend in such a manner as to run along the first and second side faces, respectively, of the connection object. Therefore, the first joining member and the second joining member can be positioned in a gap provided between the connection object fitted in the fitting chamber and the inner wall of the fitting chamber. Since such a small gap is used efficiently, the increase in the size of the connector can be suppressed.

The fixing base may have a flat plate shape and include a front plate edge positioned on a side nearer to an insertion opening of the fitting chamber, and a left plate edge and a right plate edge each extending from the front plate edge toward a rear side of the fitting chamber. In such a case, the contact member extends from the front plate edge, and the first and second press-supporting members extend from the left plate edge and the right plate edge, respectively.

According to the present invention, the pair of press-supporting members extend from the left plate edge and the right plate edge, respectively. Therefore, the first contact-receiving part and the second contact-receiving part can bear a great pressing force applied thereto, with the force being evenly and effectively dispersed therebetween.

In the connector according to the present invention, even if the contact pressure to be applied from the contact member to the connection object is set to a higher level, the pressing force applied to the first press-supporting member and the second press-supporting member from the connection object that is under the contact pressure applied from the contact member can be effectively dispersed between the first press-supporting member and the second press-supporting member. Hence, according to the present invention, while the terminal and the connection object are stably kept in conductive contact with each other under an increased contact pressure, the deformation of the terminal and the housing can be prevented.

DESCRIPTION OF THE PREFERRED EMBODIMENTS

A connector 1 as an embodiment of the "connector" according to the present invention will now be described with reference to the drawings. The connector 1 according to the following embodiment is mounted on a substrate P and conductively connects a pin terminal T (see FIG. 1) as a "connection object" to a plated circuit. While the pin terminal T taken as an example in the following embodiment is a rectangular wire terminal, the connection object is not limited thereto.

Figure 1:
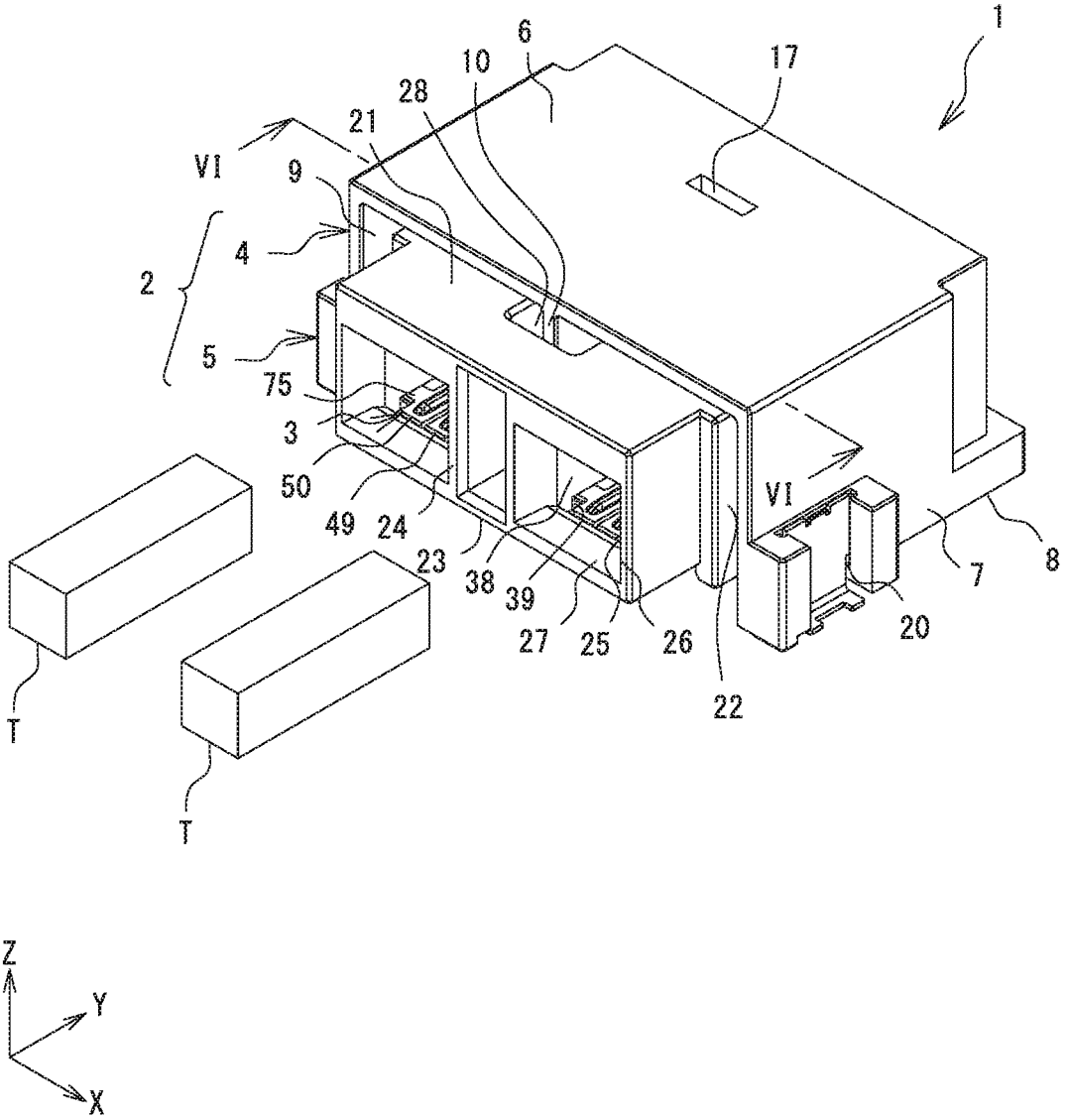
FIG. 1 is an external perspective view of a connector according to an embodiment, illustrating a front face, a right side face, and a top face thereof.
Figure 2:
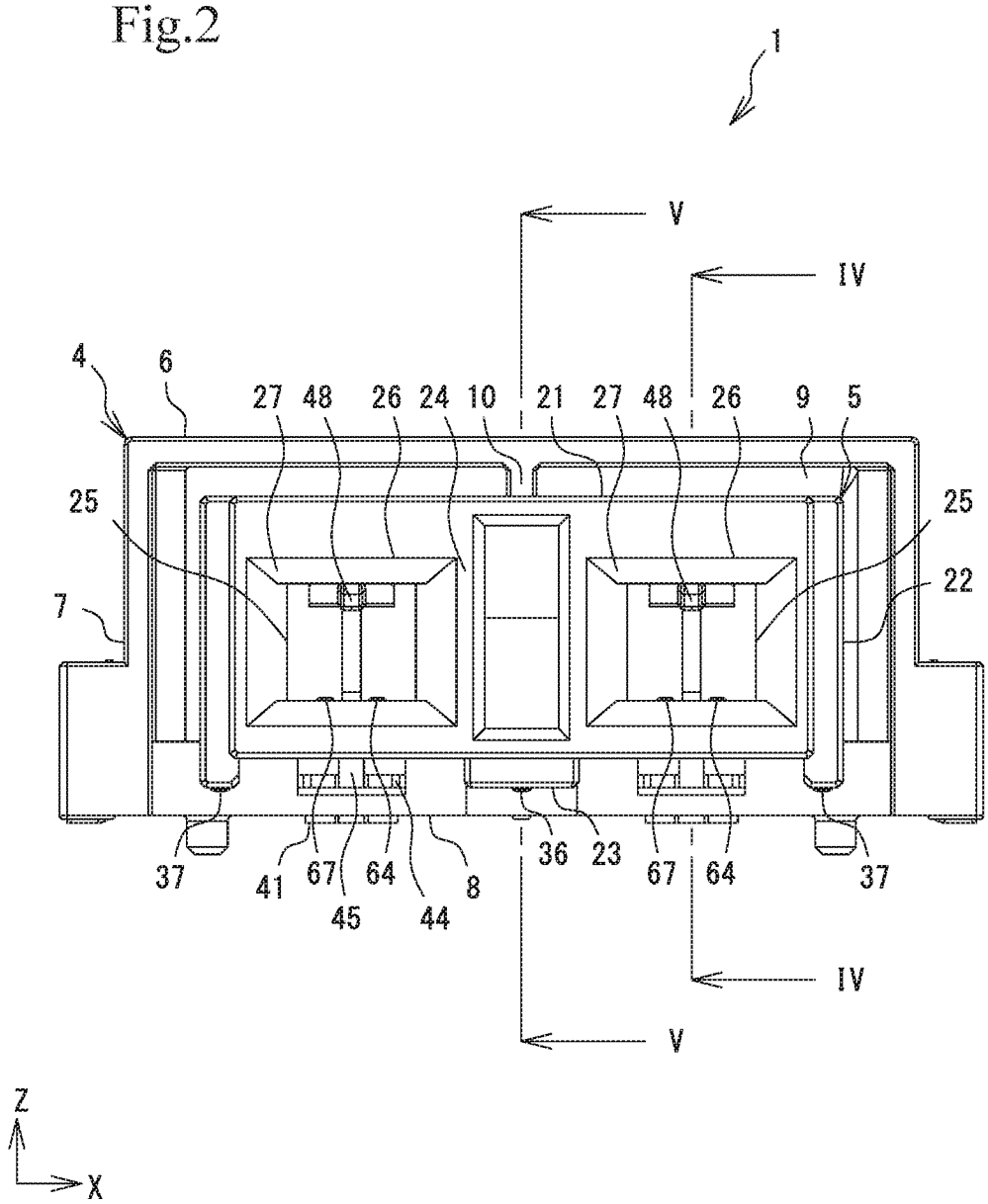
FIG. 2 is a front view of the connector illustrated in FIG. 1.
Figure 3:
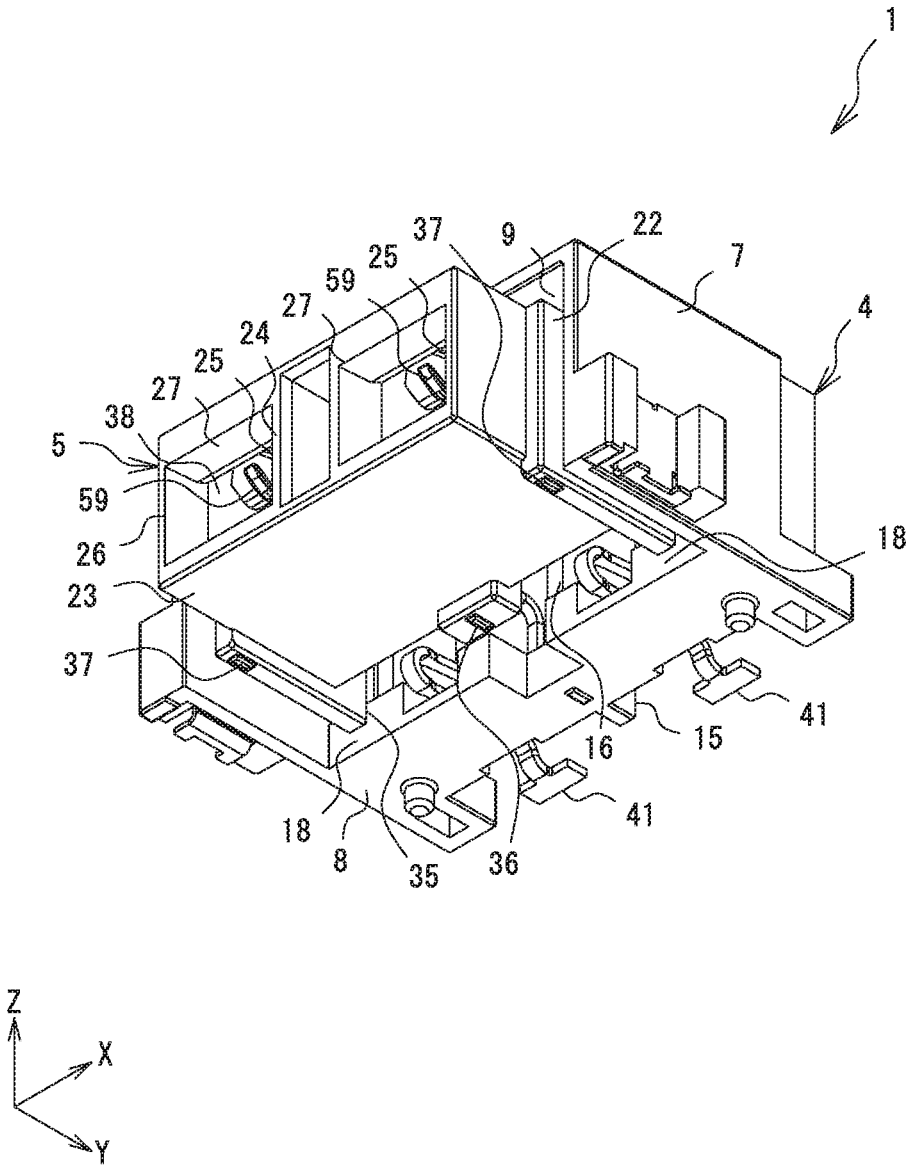
FIG. 3 is an external perspective view of the connector illustrated in FIG. 1, illustrating the front face, the right side face, and a bottom face thereof.
Figure 4:
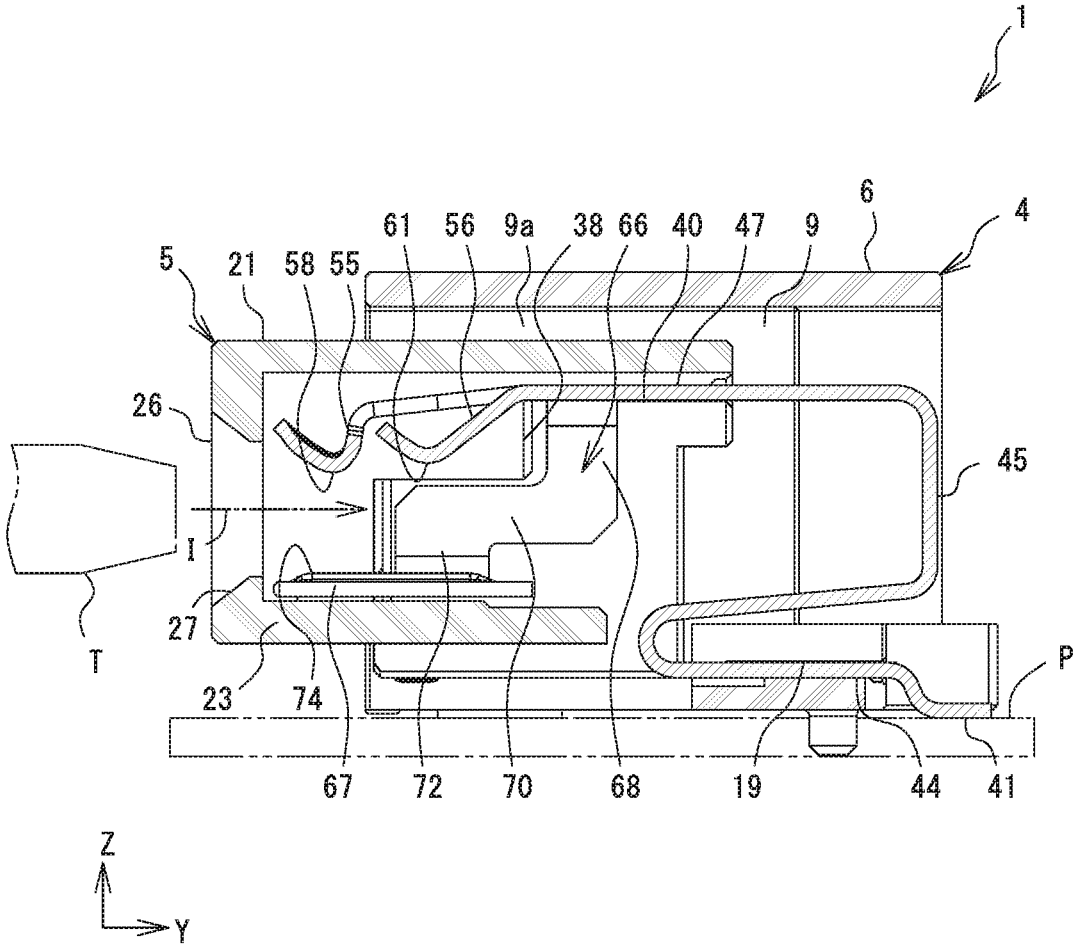
FIG. 4 is a sectional view taken along line IV-IV illustrated in FIG. 2.

The terms "first" and "second" used in this specification and the appended claims are only for distinguishing relevant elements of the invention from each other and do not define a particular order or any other characteristics, such as superiority, of such elements. In this specification and the appended claims, as a matter of convenience, directions of the connector 1 are defined as follows, as represented in FIG. 1 and others: the long-side direction (the width direction, or the horizontal direction) corresponds to the X direction, the short-side direction (the depth direction, or the front-rear direction) corresponds to the Y direction, and the height direction (the vertical direction) corresponds to the Z direction. Furthermore, in the height direction, a side of the connector 1 that is nearer to the substrate P (see FIGS. 4 to 6) is defined as "lower side", and a side of the connector 1 that is opposite the lower side is defined as "upper side". Note that the above definitions do not limit the direction in which the terminal or any other relevant element is fitted into the connector 1 or the way the connector 1 is mounted on the substrate P.

Connector 1

Referring to FIG. 1, the connector 1 includes a housing 2 and terminals 3. The connector 1 is configured to allow pin terminals T to be inserted thereinto and removed therefrom along a surface of the substrate P from the front side of the housing 2 in the Y direction. The connector 1 is configured to allow the terminals 3 thereof to be in conductive contact with the respective pin terminals T inserted thereinto. The connector 1 illustrated in FIG. 1 includes two terminals 3 positioned side by side in the X direction (the horizontal direction). Alternatively, the connector 1 may include only one terminal 3 or three or more terminals 3.

Housing 2

The housing 2 is mounted on the substrate P. The housing 2 includes a fixed housing 4 as a "first housing", and a movable housing 5 as a "second housing". The movable housing 5 is movable with respect to the fixed housing 4.

Fixed Housing 4

The fixed housing 4 is a molded body made of electrically insulating resin and has a rectangular tubular shape through which a hollow space extends in the Y direction (the front-rear direction). The fixed housing 4 includes a top wall 6 extending along the substrate P, right and left side walls 7 each extending from the top wall 6 toward the substrate P, and a bottom wall 8 extending between the right and left side walls 7 and along the substrate P. The top wall 6, the right and left side walls 7, and the bottom wall 8 define a space serving as a housing portion 9 on the inner side thereof. The movable housing 5 is positioned in the housing portion 9.

The bottom wall 8 extends in a rear part of the fixed housing 4 and is not present in a front part of the fixed housing 4. Therefore, the housing portion 9 faces the substrate P.

The top wall 6 has a bumper projection 10 as a "first bumper portion" at the center thereof in the X direction at the front end thereof in the Y direction. The bumper projection 10 has a projection shape that is elongated in the direction of insertion and removal of the pin terminal T. The bumper projection 10 has a flat plate shape whose thickness direction corresponds to the X direction of the fixed housing 4 and that projects from the top wall 6 toward the substrate P. The bumper projection 10 has bumper-portion side surfaces 11 on two respective sides thereof in the X direction. The bumper-portion side surfaces 11 are each a rectangular surface extending in a Y-Z plane. The bumper projection 10 further has a front bumper part 12 and a rear bumper part 13 at the front and rear ends thereof, respectively, in the Y direction. The front bumper part 12 and the rear bumper part 13 are each a rectangular flat surface extending in an X-Z plane. The bumper projection 10 further has a lower bumper part 14 at the lower end thereof in the Z direction. The lower bumper part 14 is a rectangular flat surface extending in an X-Y plane.

The top wall 6 has a vertical plate 15 at the center thereof in the X direction at the rear end thereof in the Y direction. The vertical plate 15 serves as a "first movement-stopping portion" provided for the movable housing 5. The vertical plate 15 has a flat plate shape whose thickness direction corresponds to the X (width) direction of the fixed housing 4. The vertical plate 15 extends in the Y-Z plane and joins the top wall 6 and the bottom wall 8. The vertical plate 15 is longer in the Y direction than in the X direction. The vertical plate 15 has a movement-stopping surface 16 at the front end thereof in the Y direction. The movement-stopping surface 16 is a rectangular flat surface extending in the X-Z plane. The movement-stopping surface 16 receives the movable housing 5 that bumps thereagainst when the movable housing 5 is displaced in the Y direction. The movement-stopping surface 16 has a function of stopping the displacement of the movable housing 5.

The top wall 6 has a fitting-position-checking window 17 at the center thereof in the X direction on the rear side thereof in the Y direction. The fitting-position-checking window 17 extends through the top wall 6 in the Z direction. The fitting-position-checking window 17 has a rectangular shape in plan view, with the rear end thereof being flush with the movement-stopping surface 16 of the vertical plate 15.

The bottom wall 8 has front bumper surfaces 18 at the front end thereof in the Y direction on two respective outer sides thereof in the X direction. The front bumper surfaces 18 each also serve as a "first movement-stopping portion" provided for the movable housing 5. The front bumper surfaces 18 are each a rectangular flat surface extending in the X direction and in the X-Z plane.

The bottom wall 8 has terminal-fixing portions 19. The terminal-fixing portions 19 each have a groove shape extending in the Y direction from the rear end of the bottom wall 8. Since the connector 1 includes two terminals 3, two terminal-fixing portions 19 are provided on the right and left sides, respectively, across the vertical plate 15 from each other in the X direction.

The right and left side walls 7 each have a fixing-member-attaching portion 20 on the outer side thereof in the X direction at the front end thereof in the Y direction. The fixing-member-attaching portion 20 has a groove shape extending in the Z direction from the upper end of each of the side walls 7.

Movable Housing 5

Referring to FIGS. 1 to 6, the movable housing 5 is a molded body made of electrically insulating resin and has a rectangular tubular shape through which a hollow space extends in the Y direction. The movable housing 5 includes an upper wall 21 extending along the substrate P, right and left end walls 22 each extending from the upper wall 21 toward the substrate P, and a lower wall 23 extending between the right and left end walls 22 and along the substrate P. The upper wall 21, the right and left end walls 22, and the lower wall 23 form a body that is a little smaller than the housing portion 9 of the fixed housing 4, whereby a movement-allowing gap 9*a* extending in the X-Y-Z direction is provided for the movable housing 5 in the housing portion 9. Therefore, the movable housing 5 is displaceable in the X-Y-Z direction in the housing portion 9 (see FIGS. 1 to 6).

The movable housing 5 has a partition 24 at the center thereof in the X direction. The partition 24 has a flat plate shape whose thickness direction corresponds to the X direction (the width direction of the movable housing 5). The partition 24 extends in the Y-Z plane and joins the upper wall 21 and the lower wall 23. The partition 24 is longer in the Y direction than in the X direction. The inside of the movable housing 5, which has a box shape, enclosed by the upper wall 21, the right and left end walls 22, and the lower wall 23 is divided by the partition 24 into a plurality of spaces that are positioned side by side in the X direction (the direction in which the terminals 3 are positioned side by side). Thus, the terminals 3 attached adjacent to each other to the movable housing 5 are insulated from each other by the partition 24. The partition 24 having such a large area and separating the internal spaces of the movable housing 5 from each other in the Y direction and in the Z direction increases the rigidity of the movable housing 5. Therefore, the terminals 3 are assuredly press-fitted in the respective spaces.

The plurality of internal spaces enclosed by the upper wall 21, the right and left end walls 22, the lower wall 23, and the partition 24 and each extending through the movable housing 5 in the Y direction have a function (fixing-base grooves 40 to be described below) of supporting the respective terminals 3 and serve as fitting chambers 25 in which the terminals 3 are conductively connected to the pin terminals T fitted therein, respectively. The movable housing 5 has insertion openings 26 provided in the front face thereof for receiving the pin terminals T. The insertion openings 26 communicate with the respective fitting chambers 25. The insertion openings 26 each have a funnel-shaped guiding slope 27. The guiding slope 27 guides the pin terminal T to be smoothly inserted for connection into the fitting chamber 25 even if the pin terminal T is displaced in the X-Z direction from the center of the insertion opening 26.

The upper wall 21 has a bumper recess 28 as a "second bumper portion" provided at the center thereof in the X direction and extending from the center thereof in the Y direction toward the front side. The bumper recess 28 has a recess shape that receives the projection shape of the bumper projection 10. The bumper recess 28 forms a quadrangular-prism-shaped depression where the upper wall 21 is depressed in the Z direction from the upper side. The bumper recess 28 is provided in correspondence with the bumper projection 10 of the fixed housing 4. The connector 1 is configured such that the displacement of the movable housing 5 with respect to the fixed housing 4 is stopped when the bumper recess 28 bumps against the bumper projection 10. The bumper recess 28 has bumper-recess side surfaces 29 on two respective sides thereof in the X direction. The bumper-recess side surfaces 29 are each a rectangular surface extending in the Y-Z plane. The bumper recess 28 further has a front bumper-recess part 30 and a rear bumper-recess part 31 at the front and rear ends thereof, respectively, in the Y direction. The front bumper-recess part 30 and the rear bumper-recess part 31 are each a rectangular flat surface extending in the X-Z plane. The bumper recess 28 further has a bumper-recess bottom surface 32 at the lower end thereof in the Z direction. The bumper-recess bottom surface 32 is a rectangular flat surface extending in the X-Y plane.

When the bumper recess 28 provided in the upper wall 21 of the movable housing 5 bumps against the bumper projection 10 provided on the top wall 6 of the fixed housing 4, the displacement of the movable housing 5 with respect to the fixed housing 4 is stopped. Therefore, the connector 1 can have a smaller size than in a known configuration in which an element that stops the displacement of the movable housing 5 with respect to the fixed housing 4 projects from each of the side walls 7 of the fixed housing 4 and the end walls 22 of the movable housing 5.

The distance between the bumper projection 10 and the bumper recess 28 is longer in the X direction (the horizontal direction) and in the Z direction (the vertical direction) than in the Y direction (the front-rear direction). That is, the distance between each of the right and left bumper-portion side surfaces 11 and a corresponding one of the bumper-recess side surfaces 29 and the distance between the lower bumper part 14 and the bumper-recess bottom surface 32 are longer than the distance between the front bumper part 12 and the front bumper-recess part 30 and the distance between the rear bumper part 13 and the rear bumper-recess part 31. Therefore, even if the movable housing 5 is displaced significantly with respect to the fixed housing 4, the bumper projection 10 and the bumper recess 28 do not bump against each other or are less likely to bump against each other in the X direction and in the Z direction than in the Y direction.

The distance between the bumper projection 10 and the bumper recess 28 in the X direction may be longer than the distance between each of the side walls 7 of the fixed housing 4 and a corresponding one of the end walls 22 of the movable housing 5. If the connector 1 has such a configuration, the displacement of the movable housing 5 in the X direction with respect to the fixed housing 4 is stopped by the side walls 7 and the end walls 22, and the bumper projection 10 and the bumper recess 28 do not bump against each other.

With the bumper projection 10 and the bumper recess 28 configured as above, the movable housing 5 can be made smaller in the X direction (the width direction) than in a hypothetical case where the bumper projection 10 and the bumper recess 28 are each elongated in the X direction. Furthermore, the bumper projection 10 does not strongly bump against the bumper recess 28 in the X direction, which corresponds to the thickness direction of the bumper projection 10 in which the strength is lower than in the other directions. Therefore, while the movable housing 5 has a small size, damage to the bumper projection 10 or the bumper recess 28 that may be caused by the displacement of the movable housing 5 in the X direction with respect to the fixed housing 4 can be prevented.

The bumper recess 28 is included in the partition 24 that separates the adjacent fitting chambers 25 from each other. The partition 24 is a combination of a plurality of walls with a hollow provided therebetween. Hence, the partition 24, in which no pin terminals T fitted in the movable housing 5 are positioned, can be efficiently used as a member for providing the bumper recess 28. With the bumper projection 10 and the bumper recess 28 configured as above, there is no need to provide an additional member to the movable housing 5 only for providing the bumper recess 28. Hence, the connector 1 can have a smaller size in the X direction than in a hypothetical case where the displacement of the movable housing 5 is stopped by using the side walls 7 and the end walls 22.

Figure 5:
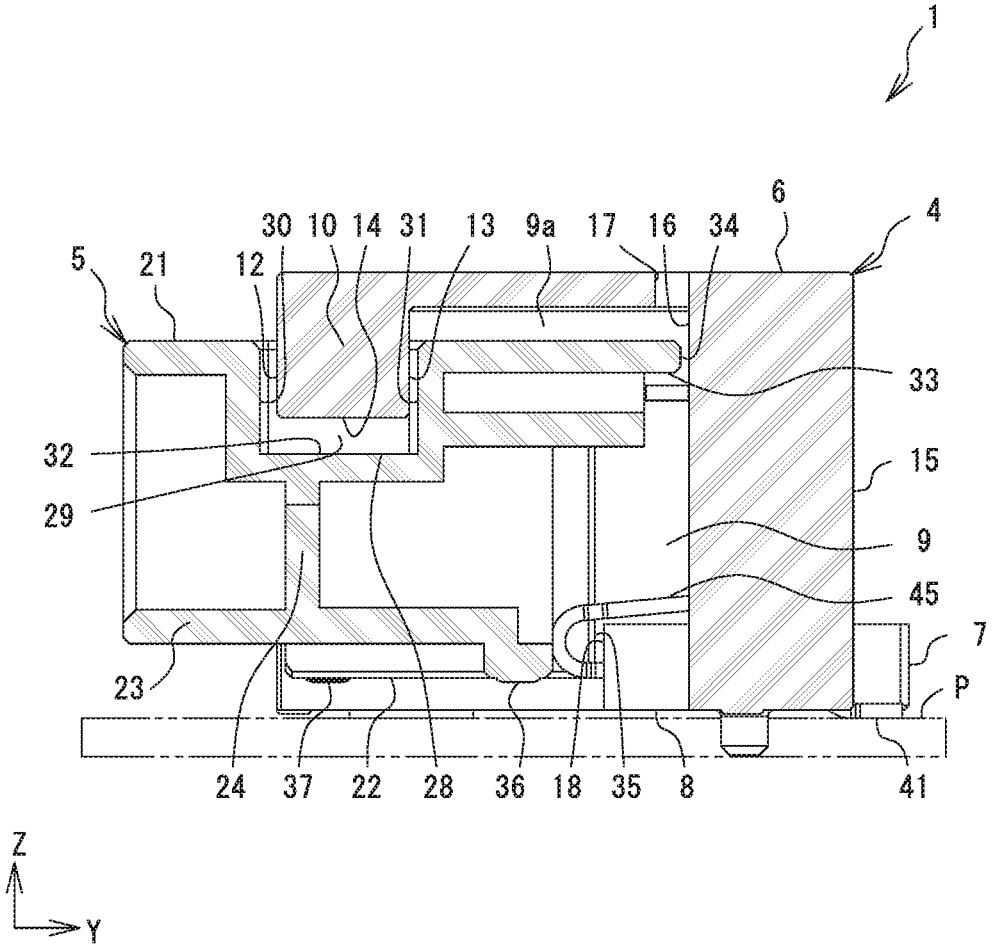
FIG. 5 is a sectional view taken along line V-V illustrated in FIG. 2.
Figure 6:
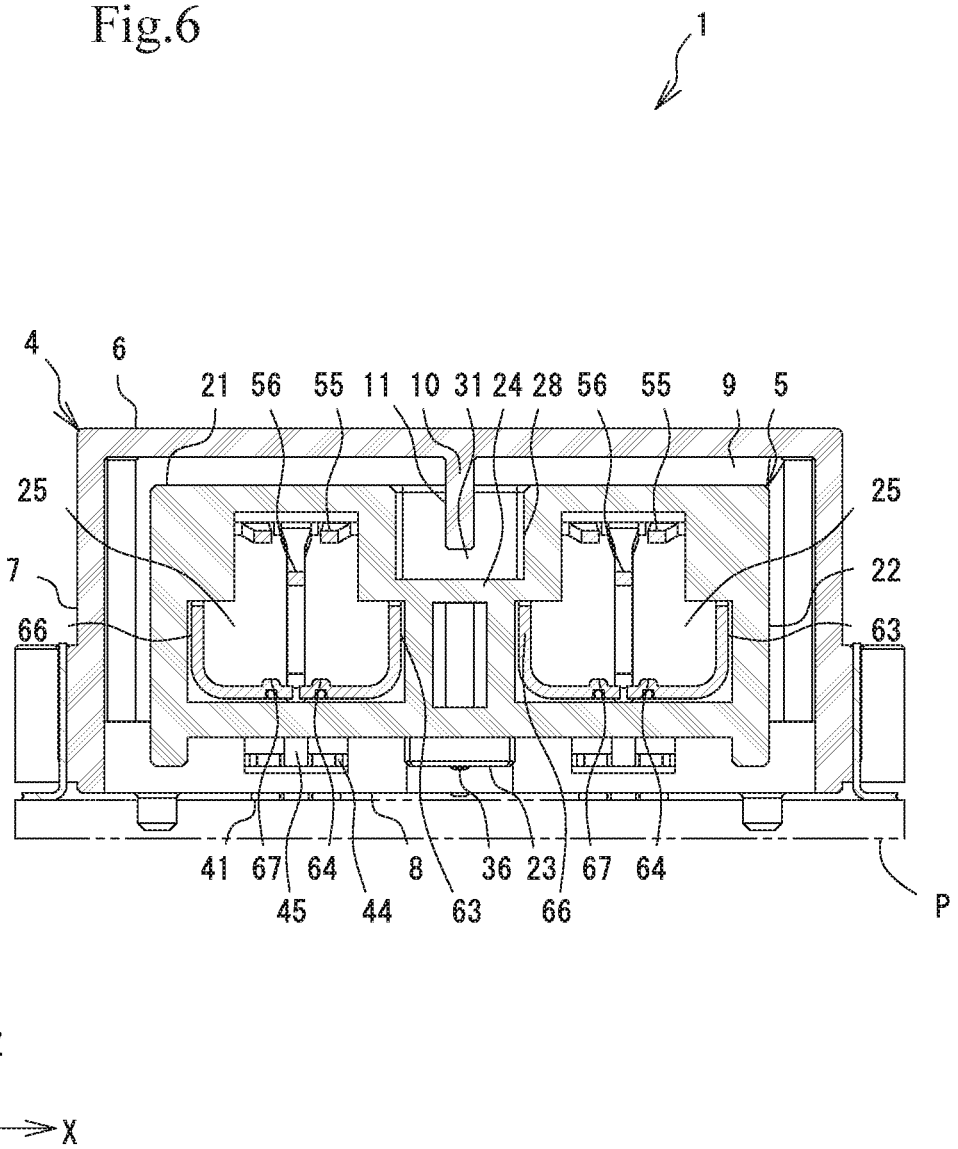
FIG. 6 is a sectional view taken along line VI-VI illustrated in FIG. 1.

The relationship of a projection and a recess between the bumper projection 10 forming a projection shape in the fixed housing 4 and the bumper recess 28 forming a recess shape in the movable housing 5 illustrated in FIGS. 1, 5, and 6 may be inverted.

The upper wall 21 has a movement-stopping extension 33 as a "second movement-stopping portion" at the center thereof in the X direction at the rear end thereof in the Y direction. The movement-stopping extension 33 has a flat plate shape extending from the rear end of the upper wall 21 in the Y direction and in the X-Y plane. The movement-stopping extension 33 has a rectangular shape in plan view that is longer in the X direction than in the Y direction. The movement-stopping extension 33 has an extension rear part 34 at the rear end thereof in the Y direction. The extension rear part 34 is a rectangular flat surface extending in the X-Z plane. When the movable housing 5 is displaced rearward in the Y direction with respect to the fixed housing 4, the extension rear part 34 bumps against the movement-stopping surface 16 of the vertical plate 15 of the fixed housing 4.

The end walls 22 each have a movement-stopping bumper portion 35 as another "second movement-stopping portion" at the lower end thereof in the Z direction at the rear end thereof in the Y direction. The movement-stopping bumper portions 35 at the rear ends of the respective end walls 22 are each a rectangular flat surface extending in the X-Z plane and being elongated in the Z direction. When the movable housing 5 is displaced rearward in the Y direction with respect to the fixed housing 4, the movement-stopping bumper portions 35 bump against the respective front bumper surfaces 18 of the bottom wall 8 of the fixed housing 4.

To insert a pin terminal T into the connector 1, each terminal 3 needs to be elastically deformed. Therefore, a force of insertion of the pin terminal T into the connector 1 is greater than a force of removal of the pin terminal T from the connector 1 by a force of elastic deformation of the terminal 3. Accordingly, the connector 1 may be configured such that the bumper recess 28 bumps against the bumper projection 10 only in the direction of removal of the pin terminal T.

Hence, in the connector 1, a gap that allows the displacement of the movable housing 5 with respect to the fixed housing 4 in the direction of removal of the pin terminal T is set smaller than a gap that allows the displacement of the bumper recess 28 with respect to the bumper projection 10 in the direction of removal of the pin terminal T. Specifically, in the connector 1, a gap between a wall of the fixed housing 4 and a wall of the movable housing 5 that face each other in the direction of removal of the pin terminal T is set smaller than the gap that allows the displacement of the bumper recess 28 with respect to the bumper projection 10 in the direction of removal of the pin terminal T. Furthermore, in the connector 1, the distance between the front bumper part 12 and the front bumper-recess part 30 is set longer than the distance between the movement-stopping surface 16 and the extension rear part 34 and the distance between each of the front bumper surfaces 18 and a corresponding one of the movement-stopping bumper portions 35.

In the connector 1 configured as above, when the movable housing 5 is displaced rearward in the Y direction, the above elements (the movement-stopping surface 16 and the extension rear part 34 or each of the front bumper surfaces 18 and a corresponding one of the movement-stopping bumper portions 35) bump against each other before the front bumper part 12 and the front bumper-recess part 30 bump against each other. That is, when the pin terminal T is inserted into the connector 1 with the force of insertion that is greater than the force of removal, the bumper projection 10 and the bumper recess 28 do not bump against each other. Hence, there is no need to increase the thicknesses of the bumper projection 10 and the bumper recess 28 in the X direction (the thickness direction) in order to make the bumper projection 10 and the bumper recess 28 strong enough to bear the force of insertion.

Such a configuration of the bumper projection 10 and the bumper recess 28 makes the movable housing 5 smaller in the X direction (the width direction) than in a hypothetical case where the bumper projection 10 and the bumper recess 28 have increased thicknesses in the X direction so as to bear the force of insertion. In the first place, the bumper projection 10 and the bumper recess 28 are free from the force of insertion. Therefore, while the movable housing 5 has a small size, damage to the bumper projection 10 and the bumper recess 28 that may be caused by the displacement of the movable housing 5 with respect to the fixed housing 4 can be prevented.

If the bumper projection 10 and the bumper recess 28 bump against each other at the insertion of the pin terminal T into the connector 1, the movable housing 5 bumps against the fixed housing 4 at the above four points. If the bumper projection 10 and the bumper recess 28 do not bump against each other at the insertion of the pin terminal T into the connector 1, the movable housing 5 bumps against the fixed housing 4 at three points. That is, the connector 1 is configured such that the force applied to the fixed housing 4 at the insertion of the pin terminal T into the connector 1 is dispersed among the three or four points. Since the connector 1 is configured such that the force of insertion of the pin terminal T is dispersed among a plurality of points of the fixed housing 4, the fixed housing 4 is less damageable. Furthermore, since the fixed housing 4 does not need to include, for example, a thick rear bumper part, the connector 1 can have a reduced size in the direction of insertion of the pin terminal T.

The lower wall 23 has a center substrate-bumper portion 36 as a "substrate-bumper portion" at the center thereof in the X direction at the rear end thereof in the Y direction. The center substrate-bumper portion 36 is a protrusion protruding from the lower end of the lower wall 23 in the Z direction and being longer, in plan view, in the Y direction than in the X direction. When the movable housing 5 is displaced with respect to the fixed housing 4 significantly in a direction toward the substrate P (downward), the center substrate-bumper portion 36 bumps against the substrate P.

The end walls 22 each have an outer substrate-bumper portion 37 as another "substrate-bumper portion" on the front side with respect to the center thereof in the Y direction. The outer substrate-bumper portion 37 is a protrusion protruding from the lower end of the end wall 22 in the Z direction and being longer, in plan view, in the Y direction than in the X direction. When the movable housing 5 is displaced with respect to the fixed housing 4 significantly in the direction toward the substrate P (downward), the outer substrate-bumper portions 37 bump against the substrate P.

As described above, the bottom wall 8 of the fixed housing 4 is not present in the front part. The housing portion 9 is defined on four sides thereof by the top wall 6 and the side walls 7 of the fixed housing 4, and the bottom wall 8 (the rear wall) and the vertical plate 15 that are present only in the rear part of the fixed housing 4. Hence, the housing portion 9 faces the substrate P, and the movable housing 5 is positioned in the housing portion 9. That is, the lower wall 23 of the movable housing 5 faces the substrate P. In the part of the housing portion 9 where the movable housing 5 is positioned, the fixed housing 4 does not have the bottom wall 8. Therefore, the movable housing 5 can be positioned nearer to the substrate P with no consideration for a gap for allowing the displacement of the movable housing 5. Consequently, the height of the connector 1 can be reduced.

When the movable housing 5 is displaced with respect to the fixed housing 4 significantly downward in the Z direction, the movable housing 5 bumps against the substrate P at the above three points: namely, the center substrate-bumper portion 36 and the outer substrate-bumper portions 37. Thus, the connector 1 is configured such that the downward displacement of the movable housing 5 in the Z direction is stopped by the substrate P, not by the fixed housing 4. Therefore, the length of allowable downward displacement of the movable housing 5 can be made longer or the size of the connector 1 in the Z direction can be made smaller than in a case where the downward displacement of the movable housing 5 in the Z direction is stopped by using the fixed housing 4.

In each of the fitting chambers 25, the end wall 22 and the partition 24 include respective guide walls 38 extending toward each other in the X direction. The guide walls 38 each extend in the Y direction from the insertion opening 26. The guide walls 38 have a function of preventing the direction of insertion of the pin terminal T from deflecting in the X direction. Assuming that a pin terminal T is appropriately inserted into the fitting chamber 25, a virtual line passing through the X-direction center of the pin terminal T and extending in the direction of insertion of the pin terminal T is defined as line of insertion I. The guide walls 38 have a function of correcting a pin terminal T advancing into the fitting chamber 25 while deflecting in the X direction with respect to the line of insertion I to advance along the line of insertion I. A lower part of each of the guide walls 38 in the Z direction spreads over an area on the front side of the fitting chamber 25 in the Y direction. An upper part of each of the guide walls 38 in the Z direction spreads over an area extending from the front to the center of the fitting chamber 25 in the Y direction.

Referring to FIG. 1, the movable housing 5 has guide grooves 39. The guide grooves 39 are provided at the lower Z-direction ends at the rear Y-direction ends of the end walls 22 and the partition 24, respectively, and each extend in the Y direction from the rear end, and are formed the groove shapes. The lower surface of each of the guide grooves 39 is flush with the lower wall 23. The guide grooves 39 have a function of correcting the terminals 3 each advancing obliquely with respect to the line of insertion I to advance along the line of insertion I in the process of attaching the terminals 3 to the movable housing 5.

The movable housing 5 has fixing-base grooves 40. The fixing-base grooves 40 are provided at the upper Z-direction ends at the rear Y-direction ends of the end walls 22 and the partition 24, respectively, and are formed the groove shapes. The fixing-base grooves 40 extend in the Y direction from the rear end of the movable housing 5. The fixing-base grooves 40 have a function of fixing the terminals 3 attached to the movable housing 5.

Terminal 3

Figure 7:
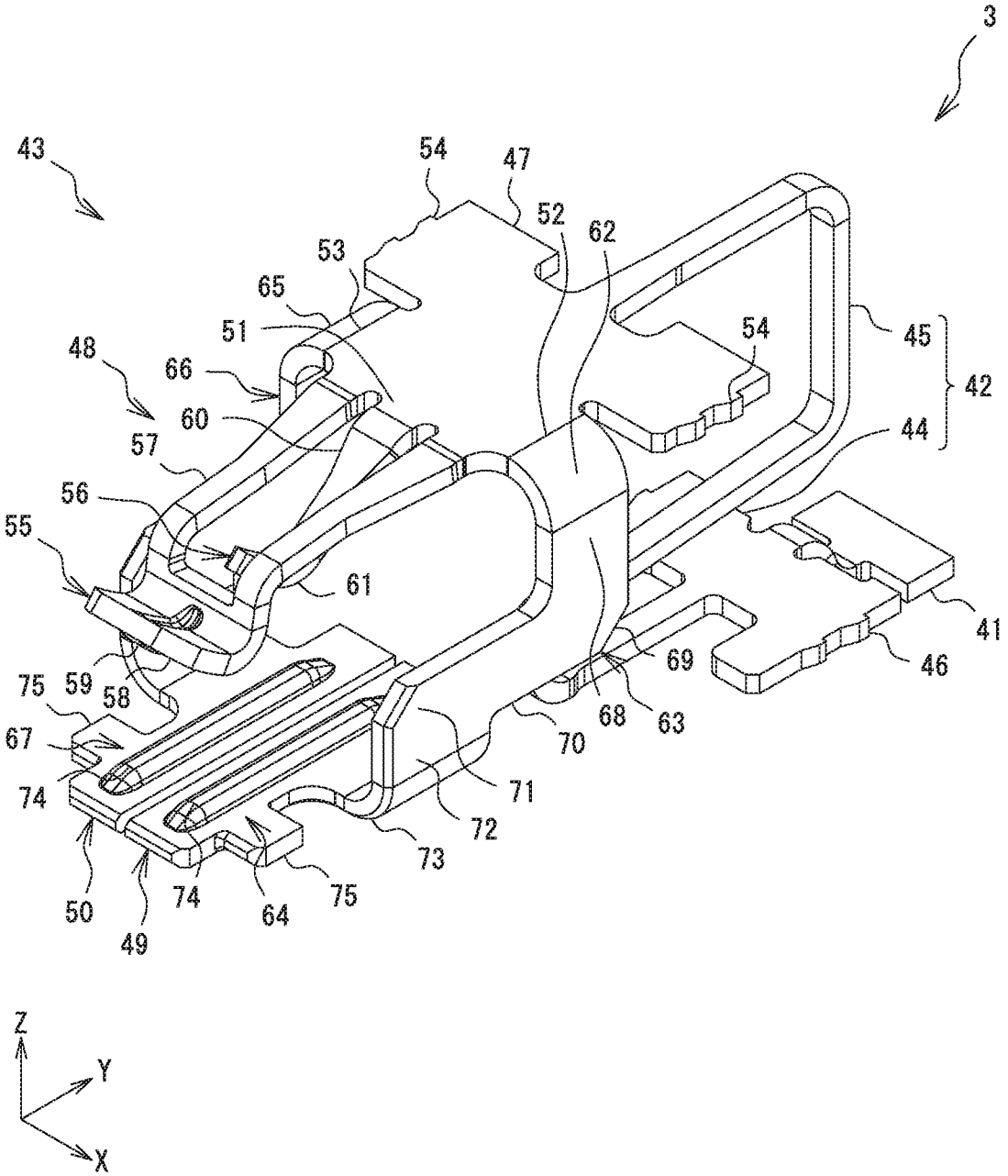
FIG. 7 is an external perspective view of a terminal, illustrating a front face, a right side face, and a top face thereof.

The terminals 3 are each an electrically conductive body made of an electrically conductive metal strip. Referring to FIG. 7 and others, each terminal 3 includes a substrate-connecting portion 41, a joining portion 42, and a contact portion 43. The terminal 3 is made of an electrically conductive flat metal sheet. Specifically, the flat metal sheet is punched into a long narrow strip and is bent, whereby the terminal 3 as a single component having different functions in different parts thereof is obtained. The terminal 3 is attached to the housing 2 such that, in most part thereof, a direction in which major surfaces extend (the width direction) corresponds to the X direction (the width direction of the connector 1), and a direction across the major surfaces (the thickness direction) corresponds to the Z direction (the height direction of the connector 1). In the connector 1, two terminals 3 are positioned side by side in the X direction (see FIGS. 1 to 3 and FIG. 6).

The substrate-connecting portion 41 is a portion at which the terminal 3 is conductively connected to a circuit provided on the substrate P and is fixed to the substrate P at the portion including one end of the terminal 3. In a state where the terminal 3 is attached to the connector 1, one end of the substrate-connecting portion 41 projects from a lower part, in the Z direction, of the back of the fixed housing 4 toward the rear side in the Y direction (see FIGS. 3 to 5). The substrate-connecting portion 41 has a rectangular flat surface extending along the substrate P. Chiefly, a lower surface of the substrate-connecting portion 41 and an upper surface of the substrate P form a soldered part, where the terminal 3 is fixed to the substrate P (see FIGS. 3 to 5).

The joining portion 42 joins the substrate-connecting portion 41 and the contact portion 43. The joining portion 42 includes a fixed-housing fixing part 44 and a movable spring part 45 as a "movable portion".

The fixed-housing fixing part 44 is a part at which the terminal 3 is fixed to the fixed housing 4. The fixed-housing fixing part 44 adjoins the other end of the substrate-connecting portion 41 and extends frontward therefrom in the Y direction. The fixed-housing fixing part 44 has an inverse U shape in plan view. A part of the terminal 3 including the substrate-connecting portion 41 and the fixed-housing fixing part 44 forms an S shape in side view, whereby the height difference in the Z direction between the substrate P and the terminal-fixing portion 19 is absorbed.

The fixed-housing fixing part 44 is wider in the X direction (the width direction) than other elements of the terminal 3 positioned on the front and rear sides thereof in the Y direction. Therefore, the fixed-housing fixing part 44 is less deformable, and a load acting in a direction around an axis extending in the Y direction (the front-rear direction) tends to be dispersed over the fixed-housing fixing part 44. Furthermore, the fixed-housing fixing part 44 is longer in the Y direction at two respective X-direction outer portions thereof than in an X-direction central portion thereof. Hence, a load acting chiefly in a direction around an axis extending in the X direction (the horizontal direction) tends to be dispersed over the fixed-housing fixing part 44.

The fixed-housing fixing part 44 has fixed-housing press-fitting protrusions 46 at two respective edges thereof in the width direction (the X direction). The fixed-housing press-fitting protrusions 46 each protrude outward in the width direction (the X direction). The fixed-housing press-fitting protrusions 46 of the fixed-housing fixing part 44 are press-fitted into and thus locked to the respective terminal-fixing portions 19 of the fixed housing 4, whereby the terminal 3 is fixed to the fixed housing 4 (see FIGS. 4 and 7).

Figure 11:
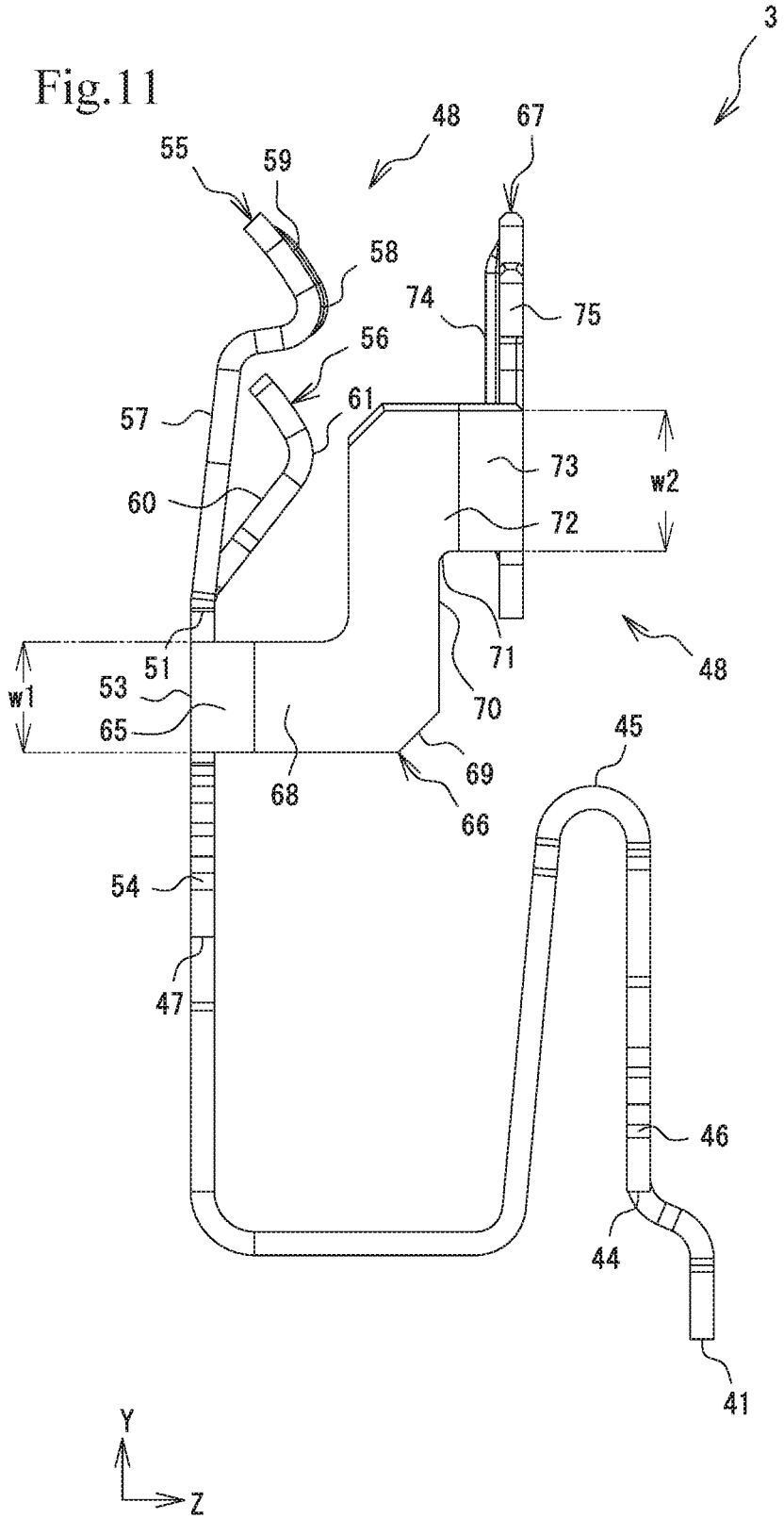
FIG. 11 is a left side view of the terminal illustrated in FIG. 7.

The movable spring part 45 has a floating function with which the movable housing 5 is supported in such a manner as to be three-dimensionally displaceable with respect to the fixed housing 4. Referring to FIGS. 7 and 11, the movable spring part 45 extends between the fixed-housing fixing part 44 and the contact portion 43. The movable spring part 45 includes a plurality of spring members each generally extending in the Y direction, and a plurality of U-shaped folded portions that each join adjacent ones of the spring members. Accordingly, the movable spring part 45 forms a shape of "2" in side view.

The movable spring part 45 is narrower than the other elements of the terminal 3: namely, the substrate-connecting portion 41, the fixed-housing fixing part 44, and the contact portion 43. Therefore, the movable spring part 45 can exert the flexibility as a spring that elastically supports the movable housing 5 while allowing the movable housing 5 to be displaced three-dimensionally.

The movable spring part 45 has a satisfactory length as a spring because the plurality of spring members each generally extending in the Y direction are arranged parallel to one another. Since the movable spring part 45 includes the plurality of spring members extending parallel to one another, the movable spring part 45 can flexibly support the movable housing 5 that is displaced particularly in the Z direction, and can have high durability as a spring. The movable spring part 45 may include more spring members, for example, five spring members. In that case, the movable spring part 45 can more flexibly support the movable housing 5 that is displaced particularly in the Z direction, and can have higher durability as a spring.

The contact portion 43 is positioned in the fitting chamber 25 of the movable housing 5 and is to be conductively connected to the pin terminal T. Referring to FIGS. 7 to 11, the contact portion 43 includes a fixing base 47, a contact member 48, a right press-supporting member 49 as a "first press-supporting member", and a left press-supporting member 50 as a "second press-supporting member". The contact portion 43 is configured to receive and hold the pin terminal T, against which the contact member 48 is pressed, by using the right press-supporting member 49 and the left press-supporting member 50.

The fixing base 47 is a part at which the contact member 48 is fixed to the movable housing 5. The fixing base 47 has a flat plate shape and extends in the Y direction from the movable spring part 45. The fixing base 47 has a front plate edge 51 at the front end thereof in the Y direction, and a right plate edge 52 and a left plate edge 53 at the right and left ends thereof, respectively, in the X direction. The right plate edge 52 and the left plate edge 53 each extend from the front end toward the rear side in the Y direction. The front plate edge 51 adjoins the contact member 48 extending frontward in the Y direction. The right plate edge 52 adjoins the right press-supporting member 49 extending downward in the Z direction. The left plate edge 53 adjoins the left press-supporting member 50 extending downward in the Z direction.

As described above, the right press-supporting member 49 and the left press-supporting member 50 extend from different positions of the fixing base 47. Therefore, when the contact member 48 is pressed against the pin terminal T, the pressing force received by the right press-supporting member 49 and the left press-supporting member 50 is dispersed therebetween. Hence, even if the contact pressure to be applied from the contact member 48 to the pin terminal T is increased, unintentional deformation of the terminal 3 can be prevented.

The right press-supporting member 49 and the left press-supporting member 50 extend from two X-direction sides, respectively, of the fixing base 47. Therefore, when the contact member 48 is pressed against the pin terminal T, the pressing force received by the right press-supporting member 49 and the left press-supporting member 50 is dispersed evenly and effectively therebetween. Hence, even if the contact pressure to be applied from the contact member 48 to the pin terminal T is increased, unintentional deformation of the terminal 3 can be prevented more assuredly.

The fixing base 47 has movable-housing press-fitting protrusions 54 at two respective edges thereof in the X direction. The movable-housing press-fitting protrusions 54 are positioned on the rear side in the Y direction with respect to the right plate edge 52 and the left plate edge 53. The movable-housing press-fitting protrusions 54 each protrude outward in the X direction. The movable-housing press-fitting protrusions 54 of the fixing base 47 are press-fitted into and thus locked to the respective fixing-base grooves 40 of the movable housing 5, whereby the contact member 48 is fixed to the movable housing 5 (see FIGS. 4 and 7).

The fixing base 47 only needs to allow the contact member 48 to be fixed to the movable housing 5. Therefore, for example, the connector 1 may be configured with the fixing base 47 having a recess, and the movable housing 5 having a press-fitting protrusion that is engageable with the recess. The direction in which the movable-housing press-fitting protrusions 54 protrude may alternatively be the thickness direction. In that case, the fitting chamber 25 of the movable housing 5 may have recesses that are depressed in the vertical direction.

The contact member 48 includes a front contact part 55 and a rear contact part 56.

The front contact part 55 includes two front elastic arms 57, and a front contact point 58. The two front elastic arms 57 are positioned on two respective outer sides of the fixing base 47 in the X direction (the width direction) and extend parallel to each other and frontward in the Y direction. The front elastic arms 57 are bent at respective positions near the front ends thereof toward each other in the width direction (the X direction) and are joined to each other, forming a joint. The front elastic arms 57 each extend from the fixing base 47 toward the front end thereof while descending in the Z direction toward a corresponding one of the right press-supporting member 49 and the left press-supporting member 50 (see FIG. 11).

Figure 10:
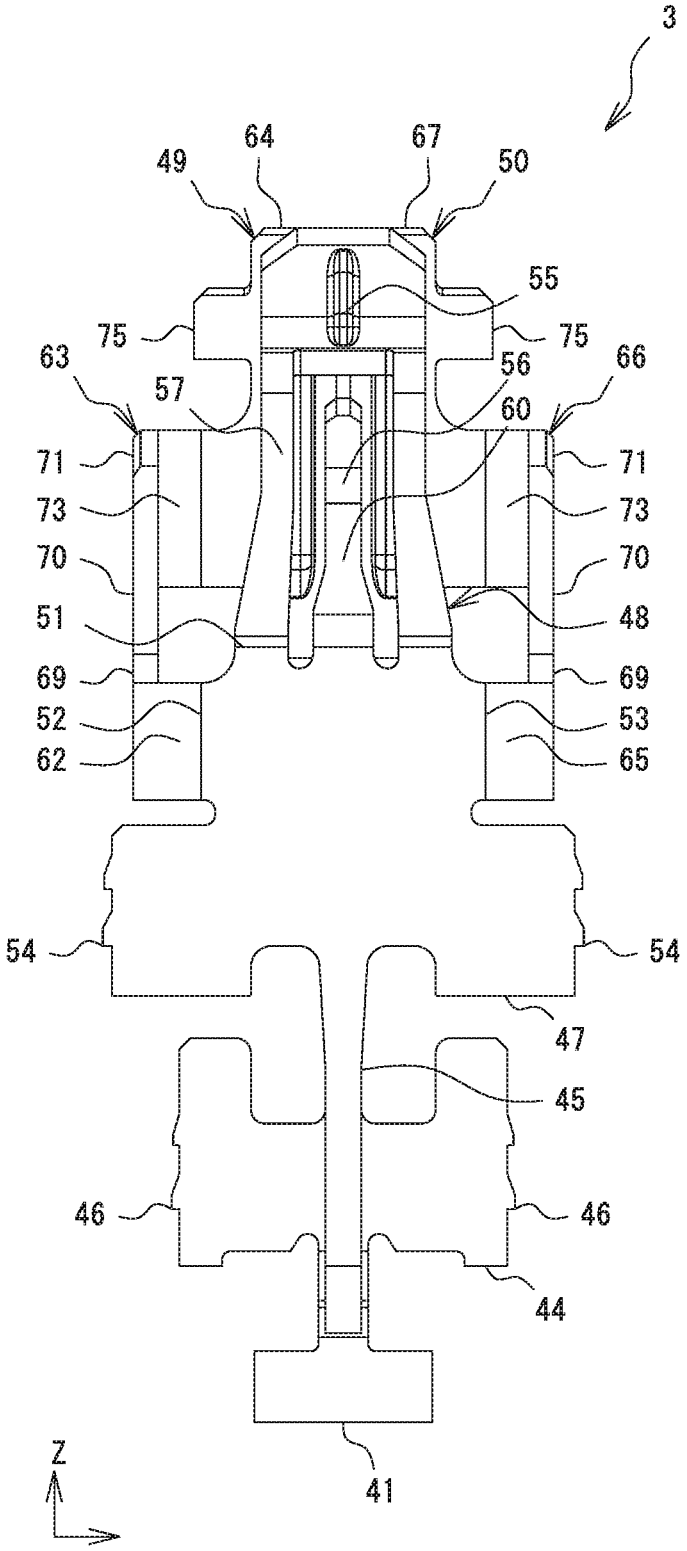
FIG. 10 is a top view of the terminal illustrated in FIG. 7.

The front contact point 58 extends further frontward in the Y direction from the joint between the front ends of the front elastic arms 57 (see FIGS. 7 and 10). The front contact point 58 forms a round V-shaped bend bulging toward the right press-supporting member 49 and the left press-supporting member 50 (see FIG. 11). The front contact point 58 is displaceably supported by the front elastic arms 57 in such a manner as to be pressed against the pin terminal T in the Z direction from the upper side toward the lower side.

The front contact point 58 may be provided as a contact surface part 59 having a bead shape a little elevated toward the right press-supporting member 49 and the left press-supporting member 50. In that case, the contact pressure occurring at the front contact point 58 can be made constant more easily, regardless of the state of insertion of the pin terminal T. Alternatively, the contact surface part 59 of the front contact point 58 may have a flat shape, instead of the bead shape. If the contact surface part 59 is flat, the front contact point 58 can be formed more easily. The front contact point 58 is positioned at the center in the X direction, i.e., straight above the line of insertion I in the Z direction. Hence, the contact pressure occurring at the front contact point 58 can be supported by and evenly dispersed in the X direction between the right press-supporting member 49 and the left press-supporting member 50.

The rear contact part 56 also has a function of being pressed against the pin terminal T in the Z direction from the upper side toward the lower side. As with the front contact part 55, the rear contact part 56 extends frontward in the Y direction from the fixing base 47. Specifically, the rear contact part 56 includes a rear elastic arm 60 positioned between the two front elastic arms 57 in the X direction (the width direction), and a rear contact point 61 that forms a round V-shaped bend and is displaceably supported by the rear elastic arm 60. The joint between the front elastic arms 57 is positioned on the front side with respect to the tip of the rear contact part 56. Hence, in plan view, the rear contact part 56 is positioned in an area enclosed by the fixing base 47 and the two front elastic arms 57 (see FIG. 10). In side view, the rear contact part 56 is positioned in an area between the front elastic arm 57 and a left contact-receiving part 67 to be described below (see FIG. 11).

The rear contact point 61 is also positioned at the center in the X direction, i.e., straight above the line of insertion I in the Z direction. Hence, the contact pressure occurring at the rear contact point 61 can be supported by and evenly dispersed in the X direction between the right press-supporting member 49 and the left press-supporting member 50.

The contact member 48 is a structure including the front contact part 55 and the rear contact part 56 as spring members extending from the fixing base 47, which is shared therebetween, in such a manner as to be positioned side by side. In such a configuration, particularly the rear elastic arm 60 can be easily provided with a satisfactory length. Therefore, when the pin terminal T is displaced, both the front elastic arms 57 and the rear elastic arm 60 can flexibly follow the displacement of the pin terminal T. Accordingly, the front contact point 58 and the rear contact point 61 are kept in good contact with the pin terminal T. Furthermore, the front contact point 58 and the rear contact point 61 are each formed as a rolled surface (a curved surface, not a cut section of a conductive metal body). Therefore, the resistance occurring at the insertion of the pin terminal T is small, and high durability against repeated insertion and removal can be provided.

In the connector 1, the right press-supporting member 49 and the left press-supporting member 50 are positioned across the line of insertion I of the pin terminal T from each other, on the right side corresponding to a "first side" and on the left side corresponding to a "second side", respectively.

Here, another configuration may be conceivable in which the "first press-supporting member" and the "second press-supporting member" are both joined to one lateral side, for example, the right side, of the fixing base 47. In such a configuration, however, the fixing base 47 becomes too long in the Y direction. To avoid such a situation, a "first extended part" and a "second extended part", which will be described below, are narrowed in the Y direction. Consequently, in such a configuration, the increase in the size of the fixing base 47 and unintentional deformation of the right press-supporting member 49 and the left press-supporting member 50 are inevitable.

In contrast, the connector 1 includes the right press-supporting member 49 and the left press-supporting member 50 provided on the right and left sides, respectively, of the fixing base 47. Therefore, the increase in the size of the fixing base 47 in the Y direction and the resulting narrowing of the right press-supporting member 49 and the left press-supporting member 50 can be prevented.

Accordingly, with the connector 1, the occurrence of situations such as the increase in the size of the fixing base 47 and unintentional deformation of the right press-supporting member 49 and the left press-supporting member 50 under the pressing force can be prevented.

The right press-supporting member 49 and the left press-supporting member 50 are symmetrical to each other in the X direction (the horizontal direction) with respect to the line of insertion I. Since the right press-supporting member 49 and the left press-supporting member 50 are symmetrical to each other, concentration of the pressing force from the contact member 48 on either of the right press-supporting member 49 and the left press-supporting member 50 can be prevented. With such a symmetrical configuration of the right press-supporting member 49 and the left press-supporting member 50, the connector 1 becomes much less deformable even if the contact pressure to be applied to the pin terminal T is set to a high level.

The right press-supporting member 49 includes a right extended part 62 as a "first extended part", a right joining member 63 as a "first joining member", and a right contact-receiving part 64 as a "first contact-receiving part". Likewise, the left press-supporting member 50 includes a left extended part 65 as a "second extended part", a left joining member 66 as a "second joining member", and a left contact-receiving part 67 as a "second contact-receiving part". Major surfaces of the right contact-receiving part 64 and the left contact-receiving part 67 faces major surfaces of the contact member 48 in the fitting chamber 25. The right contact-receiving part 64 and the left contact-receiving part 67 are positioned side by side in a direction (the X direction) intersecting the direction of insertion of the pin terminal T into the fitting chamber 25. The right joining member 63 joins the contact member 48 and the right contact-receiving part 64 with the fixing base 47 interposed therebetween. The left joining member 66 joins the contact member 48 and the left contact-receiving part 67 with the fixing base 47 interposed therebetween.

The right press-supporting member 49 and the left press-supporting member 50 are symmetrical to each other. Therefore, regarding each pair of right and left elements that have the same configuration and produce the same advantageous effect, the one included in the right press-supporting member 49 will only be described herein.

The right extended part 62 joins the right plate edge 52 and the right joining member 63. The right extended part 62 has an arc shape in front view with an interior angle of 90°, whereby the fixing base 47 extending in the X-Y plane and the right joining member 63 extending in the Y-Z plane are joined.

The right joining member 63 joins the right extended part 62 and the right contact-receiving part 64. The right joining member 63 extends from the fixing base 47 in such a manner as to run along the right side face of the pin terminal T fitted in the fitting chamber 25, and is connected to the right contact-receiving part 64. Likewise, the left joining member 66 extends from the fixing base 47 in such a manner as to run along the left side face of the pin terminal T fitted in the fitting chamber 25, and is connected to the left contact-receiving part 67.

The right contact-receiving part 64 and the left contact-receiving part 67 can bear a great pressing force applied thereto, with the force being evenly and effectively dispersed therebetween. Therefore, in the connector 1, while the terminal 3 and the pin terminal T are stably kept in conductive contact with each other under an increased contact pressure, the deformation of the terminal 3 and the housing 2 can be prevented. Furthermore, the right press-supporting member 49 and the left press-supporting member 50 extend in such a manner as to run along the right and left side faces, respectively, of the pin terminal T. Therefore, the right joining member 63 and the left joining member 66 can be positioned in a gap provided between the pin terminal T fitted in the fitting chamber 25 and the inner wall of the fitting chamber 25. Since such a small gap is used efficiently, the increase in the size of the connector 1 can be suppressed.

Referring to FIG. 7, the right joining member 63 includes, in order from the side nearer to the right extended part 62, a first joining-member part 68, a first curved part 69, an elongated part 70, a second curved part 71, a second joining-member part 72, and a joining-member bent part 73. The first joining-member part 68 extends from the right extended part 62 downward in the Z direction to the first curved part 69. The first curved part 69 adjoins the first joining-member part 68 and the elongated part 70. The elongated part 70 extends in the Y direction. The second curved part 71 adjoins the elongated part 70 and the second joining-member part 72. The second joining-member part 72 extends from the second curved part 71 downward in the Z direction to the right contact-receiving part 64.

The joining-member bent part 73 joins the second joining-member part 72 and the right contact-receiving part 64. The joining-member bent part 73 has an arc shape in front view with an interior angle of 90°, whereby the second joining-member part 72 extending in the Y-Z plane and the right contact-receiving part 64 extending in the X-Y plane are joined.

The right joining member 63 includes the elongated part 70 having a satisfactory length in the Y direction. Therefore, as illustrated in FIG. 7, the joining-member bent part 73 is positioned on the front side in the Y direction with respect to the right extended part 62 (the far side in a direction in which the terminal 3 is inserted into the movable housing 5 in the assembling process).

In the right joining member 63 configured as above, the right contact-receiving part 64 extending from the joining-member bent part 73 toward the front side in the Y direction can be made shorter than in a case where, for example, the joining-member bent part 73 and the right extended part 62 are aligned in a direction (the Z direction) intersecting the Y direction. That is, since the elongated part 70 has a satisfactory length in the Y direction, the joining-member bent part 73 is positioned on the front side in the Y direction and away from the right extended part 62. Thus, the length of a portion of the right contact-receiving part 64 that is on the front side in the Y direction with respect to the joining-member bent part 73 is reduced. Nevertheless, the front portion of the right contact-receiving part 64 is long enough to reach a position in the Y direction corresponding to the front contact point 58. Hence, the front portion becomes less deformable in the Z direction. Therefore, the reduction in the contact pressure can be suppressed.

With the right joining member 63 according to the present embodiment, the front contact part 55 and the rear contact part 56 of the contact member 48 can be made longer in the Y direction than in a case where the right extended part 62 is positioned on the front side with respect to or at the same position as the joining-member bent part 73 in the Y direction. Therefore, the stress applied to the contact member 48 can be dispersed.

Let the length of the right extended part 62 (and the left extended part 65) in the Y direction (the front-rear direction) be width w1 of the right extended part 62 (and the left extended part 65), and the length of the joining-member bent part 73 in the Y direction be width w2 of the joining-member bent part 73. The pressing force applied to the right contact-receiving part 64 is likely to be received by the second joining-member part 72 and the joining-member bent part 73 rather than the right extended part 62 and the first joining-member part 68. Hence, the second joining-member part 72 is shorter than the first joining-member part 68 in the Z direction, and the width w2 of the joining-member bent part 73 is greater than the width w1 of the right extended part 62. Thus, the second moment of area acting on the joining-member bent part 73 is made greater than that acting on the right extended part 62. Therefore, the deformation of the right contact-receiving part 64 in a direction away from the right joining member 63 at the application of the pressing force thereto can be suppressed. Furthermore, the pressing force received by the right contact-receiving part 64 is effectively dispersed in such a manner as to be evenly borne by the right extended part 62 and the joining-member bent part 73, without concentrating on either of the two.

The right joining member 63 has a Z shape in side view. In the configuration including the first curved part 69 and the second curved part 71, the stress concentration on the joining-member bent part 73 and the right extended part 62, which are each at an end of the joint, at the application of a load to the right contact-receiving part 64 can be prevented more assuredly than in a case where the right extended part 62 and the right contact-receiving part 64 are joined linearly. Therefore, the deformation of the right joining member 63 can be prevented. Such a Z-shaped configuration of the right joining member 63 prevents the deformation of the right contact-receiving part 64 in every direction. Consequently, stable conductive connection between the right contact-receiving part 64 and the pin terminal T is realized.

Furthermore, the right joining member 63 is configured such that, in the Y direction, the joining-member bent part 73 is positioned farther from the folded portions of the movable spring part 45 than the right extended part 62. That is, since the right joining member 63 has a Z shape in side view, a space into which a jig is insertable for bending the right extended part 62 can be provided on the rear side in the Y direction with respect to the right contact-receiving part 64, and the movable spring part 45 can be elongated more frontward in the Y direction so as to have a satisfactory length as a spring. Alternatively, the joining-member bent part 73 may be elongated rearward in the Y direction so as to be directly joined to the first joining-member part 68. That is, an end of the first joining-member part 68 and a side of the elongated part 70 that are nearer to the right contact-receiving part 64 may be directly joined to the joining-member bent part 73. In such a configuration, the width w2 of the joining-member bent part 73 is increased further. Consequently, the right contact-receiving part 64 becomes much less deformable with respect to the right joining member 63.

The right contact-receiving part 64 is in the form of a cantilever extending from the joining-member bent part 73. The right contact-receiving part 64 facing the contact member 48 has a flat plate shape. The right contact-receiving part 64 has a contact-receiving surface 74 that faces the front contact part 55 and the rear contact part 56. The contact-receiving surface 74 is a bead-shaped protrusion protruding toward the front contact part 55 and the rear contact part 56 and extending in the Y direction (the direction of insertion of the pin terminal T). The contact-receiving surface 74 is a part that comes into contact with the pin terminal T. Therefore, the contact-receiving surface 74 is satisfactorily longer than at least the distance between the front contact point 58 and the rear contact point 61. Since the contact-receiving surface 74 has a satisfactory length in the Y direction, the rigidity of the right contact-receiving part 64 is increased further.

The right contact-receiving part 64 may be a protruding surface a little elevated from the surface of the right contact-receiving part 64 toward the front contact point 58 and the rear contact point 61. In that case, the contact pressure occurring at each of the front contact point 58 and the rear contact point 61 can be easily kept constant, regardless of the extent of insertion of the pin terminal T. The contact-receiving surface 74 of the right contact-receiving part 64 may alternatively be flat, with no bead-shaped protrusion. If the contact-receiving surface 74 is flat, the right contact-receiving part 64 can be formed more easily.

As illustrated in FIGS. 7 to 11, the right contact-receiving part 64 includes on the front side (at the tip) thereof in the Y direction a terminal-insertion-direction-regulating plate 75 for regulating the direction of insertion of the terminal 3 into the movable housing 5. The terminal-insertion-direction-regulating plate 75 is provided at the right plate edge (the outer side in the width direction) of the right contact-receiving part 64 in the X direction and projects rightward in the X direction (outward in the width direction). The terminal-insertion-direction-regulating plate 75 has a function of providing a satisfactory X-direction length (width) of the right contact-receiving part 64 and thus increasing the rigidity of the right contact-receiving part 64. Furthermore, the terminal-insertion-direction-regulating plate 75 has the following function. When the terminal 3 is attached to the movable housing 5, the terminal-insertion-direction-regulating plate 75 goes into the guide groove 39 of the movable housing 5 and slides therealong frontward in the Y direction. Thus, the terminal-insertion-direction-regulating plate 75 corrects the terminal 3 that is being inserted into the movable housing 5 obliquely with respect to the line of insertion I to advance along the line of insertion I. Since the connector 1 has the guide groove 39 and the terminal-insertion-direction-regulating plate 75, the terminal 3 can be correctly attached to the movable housing 5.

Unlike the movable-housing press-fitting protrusion 54 of the fixing base 47, the terminal-insertion-direction-regulating plate 75 is not locked to the guide groove 39. Furthermore, the Z-direction size (the thickness) of the terminal-insertion-direction-regulating plate 75 is smaller (thinner) than that of the guide groove 39. The right contact-receiving part 64 including the terminal-insertion-direction-regulating plate 75 configured as above is not fixed to the movable housing 5. Therefore, none of or only a little, if any, of the pressing force received by the right contact-receiving part 64 is transmitted to the movable housing 5. Hence, even if the contact pressure to be applied from the contact member 48 to the pin terminal T is set to a high level, the movable housing 5 is less likely to receive a great pressing force and is less likely to deform. Accordingly, the connector 1 can be made less deformable even if the contact pressure to be applied from the contact member 48 to the pin terminal T is set to a higher level.

The right press-supporting member 49 is in the form of a cantilever extending from the fixing base 47 without being fixed to the movable housing 5 at all. Therefore, the right contact-receiving part 64 is in a floated state in the fitting chamber 25 and is not in contact with the lower wall 23 of the movable housing 5. That is, the right contact-receiving part 64 faces the lower wall 23 with a gap interposed therebetween. This also applied to the terminal-insertion-direction-regulating plate 75. Hence, the right contact-receiving part 64 is not in contact with the movable housing 5. That is, the pressing force received by the right contact-receiving part 64 is not transmitted to the movable housing 5. Therefore, even if the contact pressure to be applied from the contact member 48 to the pin terminal T is set to a high level, the movable housing 5 does not deform because the movable housing 5 is free from the pressing force. Accordingly, the connector 1 can be made less deformable even if the contact pressure to be applied from the contact member 48 to the pin terminal T is set to a higher level.

The above function exerted by the right press-supporting member 49 is also given to the left press-supporting member 50. Furthermore, the right press-supporting member 49 and the left press-supporting member 50 are positioned side by side in the direction intersecting the direction of insertion of the pin terminal T. Therefore, the great pressing force can be dispersed evenly and effectively. Accordingly, in the connector 1, while the terminal 3 and the pin terminal T are stably kept in conductive contact with each other under an increased contact pressure, the deformation of the terminal 3 and the housing 2 can be prevented.

Figure 8:
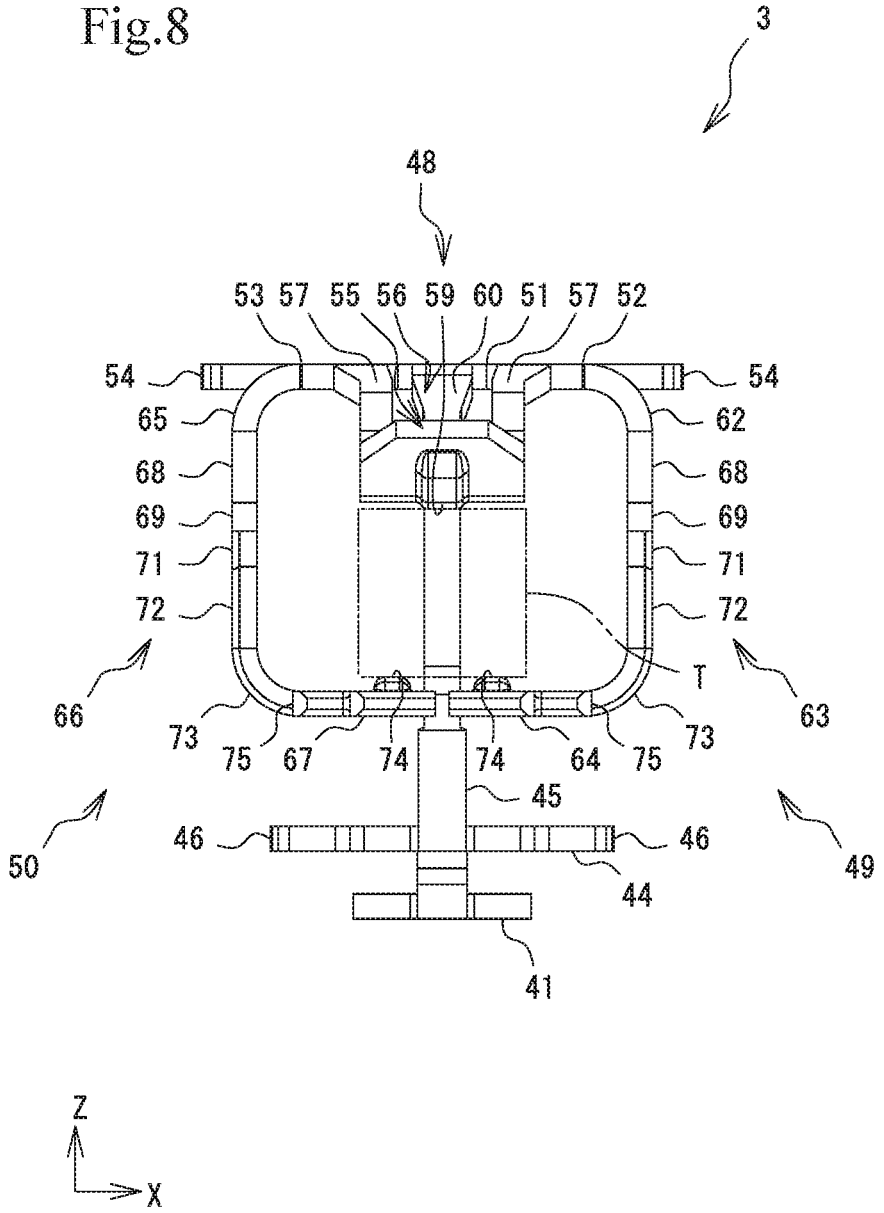
FIG. 8 is a front view of the terminal illustrated in FIG. 7.
Figure 9:
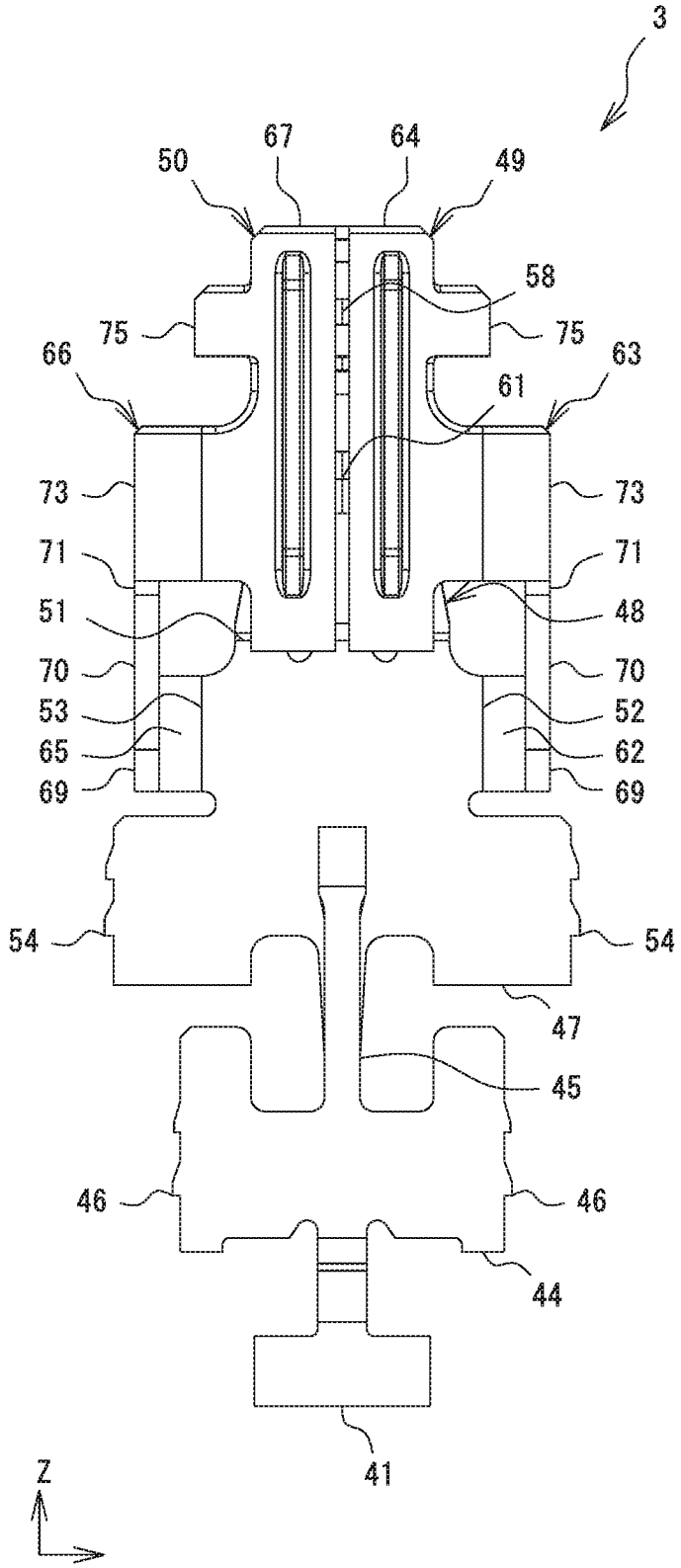
FIG. 9 is a bottom view of the terminal illustrated in FIG. 7.

Furthermore, referring to FIG. 8, the width of the contact member 48 in the X direction is set such that the contact member 48 extends over at least the outer ends of the respective bead-shaped contact-receiving surfaces 74 of the right contact-receiving part 64 and the left contact-receiving part 67. In such a configuration, the contact member 48 can be prevented from being deflected excessively even if the pin terminal T is deflected. Hence, the contact pressure occurring at the contact member 48 can be more assuredly supported by and evenly dispersed in the X direction between the right press-supporting member 49 and the left press-supporting member 50.

Modification

In the above embodiment, the right extended part 62 and the left extended part 65 extending from the fixing base 47 are at the same position in the Y direction. Alternatively, the right extended part 62 and the left extended part 65 extending from the fixing base 47 may be at different positions in the Y direction. In that case, it is preferable that the right extended part 62 and the left extended part 65 overlap in the Y direction at least in part thereof. Thus, the increase in the length of the fixing base 47 in the Y direction and the resulting narrowing of the right extended part 62 and the left extended part 65 can be prevented. Furthermore, with the connector 1 configured as above, the occurrence of situations such as the increase in the size of the fixing base 47 and unintentional deformation of the contact-receiving parts at the application of a pressing force thereto can be prevented.

What is claimed is:

1. A connector comprising:

a housing having a fitting chamber into which a connection object is to be inserted; and a terminal that comes into conductive contact with the connection object fitted in the fitting chamber, wherein the terminal includes a fixing base that is fixed to the housing;

a contact member that extends from the fixing base and is pressed against the connection object fitted in the fitting chamber; and a first press-supporting member and a second press-supporting member that each extend from the fixing base, and wherein the first press-supporting member and the second press-supporting member include a first contact-receiving part and a second contact-receiving part, respectively, the first contact-receiving part and the second contact-receiving part facing the contact member in the fitting chamber and being positioned side by side in a direction intersecting a direction of insertion of the connection object into the fitting chamber, wherein the first press-supporting member includes a first joining member that extends from the fixing base in such a manner as to run along a first side face of the connection object fitted in the fitting chamber, and is connected to the first contact-receiving part, and wherein the second press-supporting member includes a second joining member that extends from the fixing base in such a manner as to run along a second side face of the connection object fitted in the fitting chamber, and is connected to the second contact-receiving part, wherein the first press-supporting member and the second press-supporting member are configured to not press the housing after the connection object is inserted.

2. The connector according to claim 1, wherein the first press-supporting member and the second press-supporting member are each in a form of a cantilever extending from the fixing base without being fixed to the housing at all.

3. The connector according to claim 1, wherein the fixing base has a flat plate shape and includes a front plate edge positioned on a side nearer to an insertion opening of the fitting chamber; and a left plate edge and a right plate edge each extending from the front plate edge toward a rear side of the fitting chamber, wherein the contact member extends from the front plate edge, and wherein the first and second press-supporting members extend from the left plate edge and the right plate edge, respectively.

4. A connector comprising:

a housing having a fitting chamber into which a connection object is to be inserted; and a terminal that comes into conductive contact with the connection object fitted in the fitting chamber, wherein the terminal includes a fixing base that is fixed to the housing;

a contact member that extends from the fixing base and is pressed against the connection object fitted in the fitting chamber; and a first press-supporting member and a second press-supporting member that each extend from the fixing base, and wherein the first press-supporting member and the second press-supporting member include a first contact-receiving part and a second contact-receiving part, respectively, the first contact-receiving part and the second contact-receiving part facing the contact member in the fitting chamber and being positioned side by side in a direction intersecting a direction of insertion of the connection object into the fitting chamber, wherein the fixing base has a flat plate shape and includes a front plate edge positioned on a side nearer to an insertion opening of the fitting chamber; and a left plate edge and a right plate edge each extending from the front plate edge toward a rear side of the fitting chamber, wherein the contact member extends from the front plate edge, and wherein the first and second press-supporting members extend from the left plate edge and the right plate edge, respectively, wherein the first press-supporting member and the second press-supporting member are configured to not press the housing after the connection object is inserted.

* * * * *